US011717871B2

(12) United States Patent
Badegruber et al.

(10) Patent No.: US 11,717,871 B2
(45) Date of Patent: Aug. 8, 2023

(54) BENDING TOOL STORAGE DEVICE AND METHOD FOR FEEDING A PRESS BRAKE

(71) Applicant: TRUMPF Maschinen Austria GmbH & Co. KG, Pasching (AT)

(72) Inventors: Karl Badegruber, Fischlham (AT); Luigi Cavicchia, Trofarello (IT); Egon Danninger, Leonding (AT); Thomas Denkmeier, Traun (AT); Harald Fenzl, Wels (AT); Alfred Haselboeck, Peilstein (AT); Michael Kerschbaumer, Ansfelden (AT); Gerhard Kirchmayr, Leonding (AT); Florian Maier, Leonding (AT); Kabir Secibovic, Gunskirchen (AT); Andrea Tonda Roch, Turin (IT); Roberto Veronese, Chieri (IT); Giovanni Vidotto, Chieri (IT); Jochen Wruck, Pasching (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 385 days.

(21) Appl. No.: 16/480,766

(22) PCT Filed: Feb. 7, 2018

(86) PCT No.: PCT/AT2018/060032
§ 371 (c)(1),
(2) Date: Jul. 25, 2019

(87) PCT Pub. No.: WO2018/145137
PCT Pub. Date: Aug. 16, 2018

(65) Prior Publication Data

US 2020/0001340 A1 Jan. 2, 2020

(30) Foreign Application Priority Data

Feb. 8, 2017 (AT) ..... A 50099/2017

(51) Int. Cl.
*B21D 5/02* (2006.01)
*B21D 37/14* (2006.01)

(52) U.S. Cl.
CPC ..... *B21D 5/0254* (2013.01); *B21D 37/145* (2013.01); *Y10T 483/10* (2015.01); *Y10T 483/1731* (2015.01)

(58) Field of Classification Search
CPC ..... Y10T 483/1729; Y10T 483/1731; B30B 15/028; B21D 5/0254; B21D 37/145
(Continued)

(56) References Cited

U.S. PATENT DOCUMENTS 4,945,629 A * 8/1990 Schafft ..... B21D 37/145 198/465.1
5,443,166 A * 8/1995 Schutte ..... B21D 5/0254 211/163

(Continued)

FOREIGN PATENT DOCUMENTS

AT 516 624 B1 7/2016
AT 516 690 A1 7/2016

(Continued)

OTHER PUBLICATIONS

EPO Machine Translation of WO 2017004648 A1—"Storage device for storing bending tools at feeder i.e. alternation device, for filling of bending press, has guide rails aligned at relative rotational positions between outer storage tool and inner storage tools", Jan. 12 (Year: 2017).*

(Continued)

*Primary Examiner* — Erica E Cadugan
*Assistant Examiner* — Michael Vitale
(74) *Attorney, Agent, or Firm* — Collard & Roe, P.C.

(57) ABSTRACT

The invention relates to a bending tool storage device (1) for storing bending tools (2), comprising:
(Continued)

Figure 1:
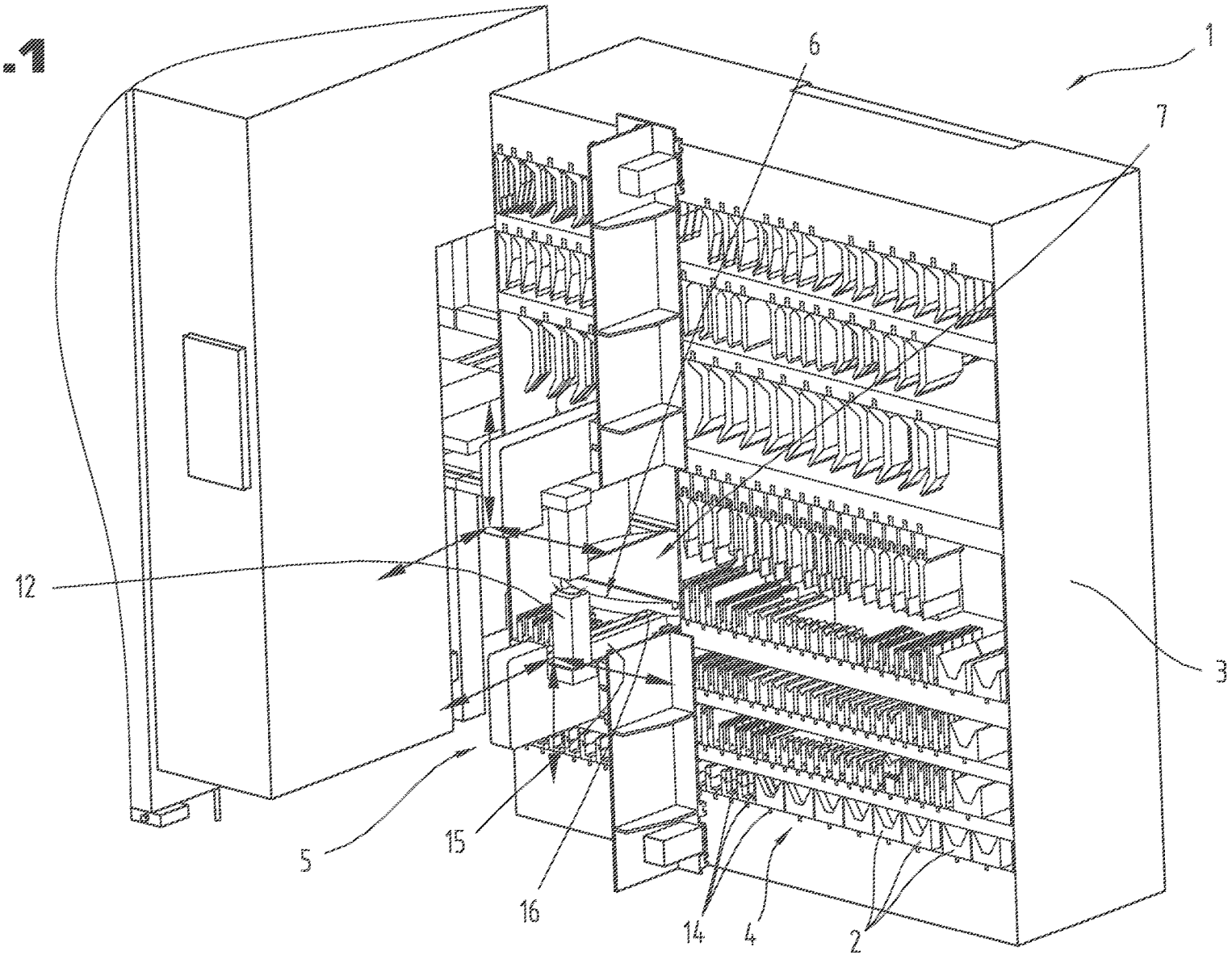

a preferably shelf-type rack (3) on which a plurality of storage locations (4) for bending tools (2) are arranged, at least one supply path (10), preferably in the form of a tool guide (11), for issuing and/or retrieving bending tools (2), and at least one first transfer device (5) for transferring bending tools (2) between the storage locations (4) and a transfer point (6), characterized in that the bending tool storage device (1) comprises, between the transfer point (6) and the supply path (10), a rotating installation (7) for rotating the bending tools (2).

34 Claims, 8 Drawing Sheets

(58) Field of Classification Search
USPC ..... 483/28, 29; 72/446
See application file for complete search history.

(56) References Cited

U.S. PATENT DOCUMENTS

| | | | | |
|---|---|---|---|---|
| 8,056,200 | B2 * | 11/2011 | Hesse | B23Q 7/02 483/14 |
| 10,092,989 | B2 | 10/2018 | Isobe | |
| 10,399,133 | B2 | 9/2019 | Felder | |
| 2004/0102297 | A1 | 5/2004 | Quak et al. | |
| 2017/0144206 | A1 | 5/2017 | Felder | |
| 2017/0320123 | A1 * | 11/2017 | Cavicchia | B21D 5/0254 |
| 2018/0193896 | A1 | 7/2018 | Haselboeck et al. | |
| 2018/0236518 | A1 | 8/2018 | Sato | |

FOREIGN PATENT DOCUMENTS

| | | | | | |
|---|---|---|---|---|---|
| CN | 1468161 | A | | 1/2004 | |
| CN | 202222745 | U | | 5/2012 | |
| CN | 106041640 | A | | 10/2016 | |
| DE | 102013013978 | B4 | | 10/2016 | |
| EP | 2 865 458 | A1 | | 4/2015 | |
| EP | 2 946 846 | B1 | | 4/2016 | |
| GB | 2282803 | A | * | 4/1995 | B65G 1/0407 |
| JP | H06-099232 | A | | 4/1994 | |
| JP | H07-275941 | A | | 10/1995 | |
| JP | 2003211223 | A | * | 7/2003 | B65G 1/0407 |
| JP | 2004-344912 | A | | 12/2004 | |
| WO | 2013/166538 | A1 | | 11/2013 | |
| WO | WO-2014002569 | A1 | * | 1/2014 | B21D 37/145 |
| WO | 2015/176083 | A1 | | 11/2015 | |
| WO | 2016/109862 | A1 | | 7/2016 | |
| WO | WO-2016109862 | A1 | * | 7/2016 | B21D 37/145 |
| WO | 2017/004648 | A1 | | 1/2017 | |

OTHER PUBLICATIONS

Machine Translation of AT516624B1—"Tool Magazine and Arrangement With Such"; Jul. 15 (Year: 2016).*

International Search Report in PCT/AT2018/060032, dated Jun. 19, 2018.

* cited by examiner

BENDING TOOL STORAGE DEVICE AND METHOD FOR FEEDING A PRESS BRAKE

CROSS REFERENCE TO RELATED APPLICATIONS

This application is the National Stage of PCT/AT2018/060032 filed on Feb. 7, 2018, which claims priority under 35 U.S.C. § 119 of Austrian Application No. A 50099/2017 filed on Feb. 8, 2017, the disclosure of which is incorporated by reference. The international application under PCT article 21(2) was not published in English.

The invention relates to a bending tool storage device according to the preamble of claim 1.

AT 516 624 B1 discloses a tool magazine with a plurality of storage locations for storing forming tools for a forming press. A transport device for transporting the forming tools is displaceable between the storage locations and a transfer position. An intermediate storage is arranged directly adjacent to a forming press and is formed by two ring-shaped tool storages rotatable as a whole. Forming tools are transported between the tool magazines and the intermediate storage, both of which have their own rack and can be used independently from one another. Such an arrangement requires a lot of space and is accompanied by significant constructional and control-engineering related effort. The storage density, i.e. the number of forming tools in relation to the required space, is too low to suffice the requirements to modern manufacturing.

EP 2 946 846 B1 discloses a tool changing device, which—similar to what is disclosed by AT 516 624 B1—discloses a ring-shaped tool storage rotatable as a whole, i.e. all storage locations are formed on the ring-shaped platform and rotate with every changing operation. Such a construction requires a strong and reliable and thus expensive drive. The forming tools must be moved (rotated) also when these are not needed.

WO 2016109862 A1 discloses a feeding device for feeding bending tools to a bending press. It comprises a tool storage with a plurality of guide rails for retaining and guiding bending tools and a transfer device for sliding the bending tools. An intermediate store with at least one guide rail is provided so as to extend the possibilities when shunting the bending tools. The tool storage and the intermediate store can be moved relative to one another.

It is the object of the present invention to overcome the shortcomings of the prior art and to provide a storage device that can be constructed with a compact design and by means of which the required space can be reduced. It is intended to speed up the loading of bending presses and/or changing of bending tools. The storage density is to be increased and the manufacturing costs are to be reduced.

The object is achieved by the aforementioned bending tool storage device by means of the bending tool storage device comprising a rotating installation for rotating the bending tools between the transfer point and the supply path.

Due to the rotating installation, the bending tools can be stored in the storage device in an orientation tilted towards the supply path. Hence, the available space can be used in an optimized manner. Moreover, the correct orientation and order of the bending tools for the bending press can already be determined in the supply path.

The rotating installation is a connector between the first transfer device and the supply path. It passes a bending tool (coming from the first transfer device) to the supply path and/or rotates a bending tool (to be delivered to the first transfer device) out of the supply path.

The first transfer device can in particular be designed such that it can collect bending tools stored in several planes of the storage device. At the transfer point, the bending tools are passed from the first transfer device to the rotating installation either directly or via an attachment point (this can for example be carried out by means of a manipulator of the first transfer device) or to an intermediate connection via which the bending tool consequently reaches the rotating installation.

The supply path (also referred to as loading path) serves the purpose of loading a connected bending press and/or (reversely) loading the storage device with bending tools. The orientation of the supply path is usually prescribed by the bending press and/or its tool holders and thus extends in parallel to the bending line of the bending press. The supply path of the storage device can comprise a tool guide for retaining and guiding bending tools. The term "supply path" within the meaning of the present application is to be understood as a path via which the bending tools can be moved away from the rotating installation (for example in the direction of a connected bending press) and/or (coming from the opposite direction) towards the rotating installation. The supply path within the meaning of the present application can, but does not have to, form a complete connection between the rotating installation and a (connected) bending press. However, the supply path of the storage device can also merely form one section of such a connection or only an attachment point at all, to which a tool guide guiding on can be connected. Supply path can also be understood as a guiding section serving as a parking position for a displaceable transfer device for moving the bending tools.

Preferably, the storage device comprises a drive, in particular a motor, that cooperates with the rotating installation and by means of which the rotating installation can be driven. In this regard, the drive can be controlled by means of a controller. The loading operation can thereby be automated.

The storage locations for the bending tools are preferably stationary, i.e. arranged fixedly relative to and/or on the rack. The rack can be of a shelf-type design, preferably with several shelf levels, for example in the form of a cabinet.

The storage locations, the first transfer device, the rotating installation and the supply path can respectively comprise one or several tool guide(s) in the form of guide rails, extending essentially horizontally, for retaining and guiding bending tools. In this respect, the bending tools are passed from one tool guide into the other and are thus reliably retained and/or guided during the entire transfer process. The tool guides preferably have a linear extent.

The bending tools for a bending press each comprise a forming section for forming a workpiece and a guiding section for retaining and guiding the bending tool in a tool guide. The guiding section thus defines the guiding direction.

Preferably, the storage device is designed for accommodating upper tools (hanging) and lower tools (standing).

Preferably, the storage device comprises a rotating installation for upper tools and a rotating installation for lower tools, wherein the rotating installations are preferably arranged on top of one another. In this regard, the rotation axes of the rotating installations can coincide.

The distance between the storage locations provided in the storage device can differ depending on the tool types, so as to allow for a packing density to be achieved that is as high as possible. For storing wider tools, larger distances between the individual storage locations are to be provided.

For thinner tools, storage locations with smaller distances are used. Storage locations can also be designed such that several (in particular equal) tools are stored in one storage location. If the storage location is formed by a tool guide and/or storage rail, several tools can be arranged behind one another.

A preferred embodiment is characterized by the rotating installation comprising at least one (preferably linear) tool guide rotatable about a preferably vertical rotation axis, which is in aligned orientation with the supply path in a first rotational position and which points towards the transfer point in a second rotational position, wherein the rotational angle between the first rotational position and the second rotational position preferably amounts to at least 45°, preferably at least 60°. Aligned orientation in particular means that a bending tool can be moved from the tool guide of the rotating installation into the tool guide of the supply path along the tool guide by means of displacement.

In this embodiment, the rotating installation can be provided in the form of a turntable. The bending tool merely has to be moved into the tool guide and to be subsequently rotated. The rotating installation thus forms a connector between the first transfer device and the supply path.

A preferred embodiment is characterized by the rotating installation comprising at least two (preferably linear) tool guides rotatable about the rotation axis, wherein the tool guides are tilted towards one another, preferably by an angle of at least 60°. Transferring bending tools to the supply path, in particular in a specific order, is significantly simplified and sped up by this measure. This is due to the fact that hence, two bending tools can be retained and/or rotated by the rotating installation or be moved relative to the rotating installation simultaneously. Hence, a bending tool can be moved from the first transfer device onto the rotating installation, while another bending tool is simultaneously moved from the rotating installation onto the supply path. The equipping operation of a bending press and thus also the total cycle times are hence noticeably shortened.

In an embodiment, the at least two tool guides cross, preferably in the rotation axis. This allows for mere flipping of a bending tool. For example, two tool guides can be tilted towards one another at 90°.

In another embodiment, the tool guides of the rotating installation extend without crossing; they are then radially spaced from the rotation axis and can for example be arranged in a triangular or square shape. Hence, no obstructions occur with several tools.

A preferred embodiment is characterized by the tool guides being arranged on a preferably disc-shaped platform, which is mounted so as to be rotatable about the rotation axis. The platform can for example be provided in the form of a circular disc or merely be a gantry, carrier or frame supporting the tool guides.

A preferred embodiment is characterized by a first tool guide of the rotating installation being in aligned orientation with the supply path and a second tool guide of the rotating installation pointing towards the transfer point in at least one rotational position of the rotating installation. Hence, the rotating installation can be loaded with a bending tool on one side (transfer point) and simultaneously be unloaded on another side (supply path).

A preferred embodiment is characterized by at least one tool guide of the rotating installation being pivotable relative to the platform about a pivot axis, which is spaced from the rotation axis and parallel to the rotation axis. The tool guide can be pivoted out for the loading operation, so as to reach an aligned orientation with the (tool guide of the) first transfer device at the transfer point. This extends the possibilities of the loading operations of the rotating installation. Irrespective of the number and arrangement of the tool guides of the rotating installation, it can thus be ensured that one tool guide is always aligned with the loading path and another tool guide is oriented for loading. To also achieve the latter, —if required—the corresponding tool guide is pivoted about the pivot axis.

The rotating installation can comprise one or several drive(s), by means of which the tool guide(s) is/are pivotable relative to the platform. In this regard, the drive can be controlled by means of a controller. The loading operation can thereby be automated.

A preferred embodiment is characterized by the pivoting movement of the at least one tool guide about the pivot axis being limited by a stop preferably provided on the platform. By means of the stop, a certain orientation can be defined, in particular that orientation in which the tool guide is aligned with the first transfer device.

A preferred embodiment is characterized in that the at least one tool guide of the rotating installation between its first end and its second end passes a plane, which is perpendicular to the longitudinal direction of the tool guide and contains the rotation axis. The tool guide thus extends beyond the mid-plane. Hence, the rotating installation can retain bending tools with minimum space being required. The diameter of a disc-shaped platform can thus be kept very low. Where the rotating installation is formed by a disc-shaped platform, it is preferred that its diameter amounts to a maximum of 1.5 times the length of the tool guides of the storage locations.

Preferably, the first end and the second end of the at least one tool guide of the rotating installation essentially have the same distances from the rotation axis. This measure also affects the space required and the compactness of the rotating installation in a positive way.

A preferred embodiment is characterized in that the at least one tool guide of the rotating installation comprises a distance from the rotation axis at the position at which it is closest to the rotation axis, wherein the distance preferably amounts to at least a quarter of the length of the tool guide. In this embodiment, the tool guides do not extend across the rotation axis but extend decentrally. It is hence prevented that the tool guides cross and the bending tools obstruct one another. By this measure, several, in particular three or four, tool guides can also be provided on the rotating installation with the lowest space being required.

A preferred embodiment is characterized in that the tool guides of the rotating installation extend along the sides of a preferably equilateral polygon, preferably an equilateral triangle or a square. In this regard, the rotation axis is located at the center of the equilateral polygon.

Such a symmetrical arrangement extends the possibilities of simultaneously loading/unloading the rotating installation.

A preferred embodiment is characterized by the storage locations each comprising a tool guide for retaining and guiding at least one bending tool. Just as the transferring, the storing can hence be carried out by means of tool guides, in particular guide rails, whereby the bending tool (with its guiding section) is constantly retained or moved in a guide.

A preferred embodiment is characterized in that the tool guides of the storage locations are tilted towards the tool guide of the supply path, preferably by an angle of at least 45°, particularly preferred by an angle of at least 60°, in particular by an angle of 60° or by an angle of 90°. As already mentioned, this results in a particularly space-saving construction. The storage locations can be arranged along the direction of the supply path behind one another. In this regard, the tool guides of the storage locations are arranged in parallel to one another at least in groups.

A preferred embodiment is characterized in that the at least one first transfer device comprises a tool holder, by means of which the storage locations and the transfer point can be approached, for holding a bending tool. The tool holder serves the purpose of securely holding the bending tool during the displacement with the first transfer device. It is preferred for the tool holder to be displaceable into at least two spatial directions (horizontally and vertically), so as to be able to approach the storage locations arranged in several planes.

A preferred embodiment is characterized in that the tool holder comprises a tool guide for retaining and guiding at least one bending tool, wherein the tool guide of the tool holder can be brought into aligned orientation with the tool guides of the storage locations. This means that the bending tools can be moved between the tool holder and the storage locations and/or the rotating installation (along the tool guide).

A preferred embodiment is characterized in that the tool guide of the tool holder is pivotable about a pivot axis that is parallel to the rotation axis of the rotating installation, preferably by an angle of at least 45°, particularly preferred by an angle of at least 60°, in particular by an angle of 60°. Hence, with a corresponding arrangement of tool guides on the rotating installation (for example three tool guides respectively tilted towards one another by 60°), at least two tool holders of the rotating installation can be loaded without the latter having to be rotated in between. This thus represents an advantageous extension of the shunting and/or equipping operations.

A preferred embodiment is characterized in that the first transfer device comprises a manipulator, which can be displaced with the tool holder, by means of which a bending tool can be moved along the tool guide into the and/or out of the tool holder. Collecting and/or storing bending tools can hence be fully automated.

A preferred embodiment is characterized in that the storage device comprises at least one second transfer device by means of which a bending tool can be moved along the tool guide of the supply path. Hence, the loading and/or return operation can be carried out independently of the first transfer device. The concept of the rotating installation represents a separation between the actual loading and/or return operation along the supply path and the collection and/or storing of the bending tools from the and/or into the storage location(s) by the first transfer device. The first transfer device and the second transfer device work in parallel. The rotating installation represents a connector between the first and second transfer devices.

The first transfer device and the second transfer device can be controllable independently by means of a controller. The transfer devices can thus work in parallel temporally.

A preferred embodiment is characterized in that the second transfer device comprises a shuttle, preferably in the form of a carriage or trolley, displaceable along the tool guide, preferably in the tool guide of the supply path, wherein preferably the shuttle comprises a releasable coupling for connecting a bending tool to the shuttle. The shuttle can be connected to an elongated traction/pressure transfer means (in particular in the form of a chain, a rope or a belt). A drive, which is preferably connected to a controller, acts on the retractable/extendable traction/pressure transfer means and hence moves the shuttle along the tool guide of the supply path. Such a drive concept is also referred to as traction/pressure actuator.

Thus, an embodiment is preferred in which the second transfer device comprises an extendable elongated (in particular flexible) traction and pressure transfer means, preferably in the form of a chain, a rope or a belt, which can be moved along the tool guide, preferably in the tool guide of the supply path. Additionally, a storage, in particular a wind-up device or a storage with a slotted guide extending spirally and/or meandering can be provided for holding the traction and pressure transfer means in the retracted state.

A preferred embodiment is characterized in that the storage locations of a first group of storage locations are formed by first tool guides parallel to one another and storage locations of a second group of tool guides are formed by second tool guides parallel to one another, wherein the first tool guides are tilted towards the second tool guides, preferably by an angle of at least 45°, particularly preferred by an angle of at least 60°, in particular by an angle of 60°.

A preferred embodiment is characterized in that the rotating installation is arranged between storage locations of the first group and storage locations of the second group. Hence, the area around the rotating installation can be used optimally for storage locations.

A preferred embodiment is characterized in that the rotating installation is supported by the rack, wherein the rotating installation is preferably arranged in a shelf compartment of the rack. The rotating installation is thus supported by the same rack the storage locations are arranged on. The storage device can be realized as a compact construction and combine all functions in it (storage, provision in a desired order and orientation and loading of a bending press).

A preferred embodiment is characterized in that the supply path comprises a first guiding section and a second guiding section, wherein at least a part of the second transfer device is arranged in the first guiding section in its retracted position and wherein a bending tool can be moved out of and/or into the storage device along the second guiding section, and in that at least a part of the rotating installation is arranged between the first guiding section and the second guiding section of the supply path. Thus, on the one hand a parking position for the second transfer device is created, on the other hand the second transfer device can simultaneously be used for transferring a bending tool from the rotating installation into the supply path and (without changing the direction of movement) for loading a bending press.

A preferred embodiment is characterized in that the storage locations are arranged in at least two planes, wherein preferably several storage locations are arranged in one shelf compartment of the rack.

Preferably, at least a part of the storage locations is arranged below and/or above the rotating installation. By means of these measures, optimum use is made of the available space.

A preferred embodiment is characterized in that the at least one first transfer device is arranged on a first side of the rack and the supply path is arranged on a side of the rack opposing the first side, wherein the rotating installation forms a passage between the opposing sides of the rack. Hence, the transfer devices are not in each other's way and the maximum freedom of movement is maintained.

A preferred embodiment is characterized in that the first transfer device, the second transfer device and the rotating installation each comprise at least one drive and/or actuator and can be controlled by means of a controller. Hence, the individual actions of the different components can be best coordinated. In concrete terms, the first transfer device and the second transfer device each comprise at least one displacement drive and the rotating installation comprises a rotary drive (for rotating the tool guide about the rotation axis).

A preferred embodiment is characterized in that the storage device can be extended in a modular manner and/or is formed by at least two storage modules that are connected to one another in a detachable manner and each comprise a plurality of storage locations. Hence, the storage capacity can be adapted as required. For example, a first storage module (which also comprises the rotating installation) with a corresponding storage capacity of tools can be provided as basic equipment. A second storage module offers the possibility of storage extension, for example for the processing of thick sheet and/or thin sheet and/or other types of workpieces. The storage size can be extended as desired by mounting and/or connecting further storage modules.

A preferred embodiment is characterized in that the storage device comprises at least one loading station accessible from outside the storage device, preferably via a loading hatch, for in particular manually loading the storage device with bending tools, wherein preferably the loading station can be approached by the first transfer device and/or is formed by at least one tool guide. This allows for insertion and removal of tools in parallel to the primary processing time during operation by an operator, meaning that the equipping and/bending operations do not have to be interrupted to allow for the use of new (previously not present in the storage device) tools.

The invention also relates to an arrangement of a bending press and at least one bending tool storage device connected to the bending press and/or its tool mount(s). In this regard, it is preferred if a first storage device is connected on one side of the bending press and a second side is connected at the opposite side of the bending press. In this regard, the storage devices are (indirectly) connected to one another via the tool mount(s) of the bending press. Hence, the equipping and changing operations can be carried out even faster.

The object is also achieved by a method for loading a bending press with bending tools and/or for changing bending tools in a bending press, wherein the bending press is connected to a bending tool storage device according to the invention, and that bending tools can be output to the bending press and/or taken in by the bending press between the storage locations of the bending tool storage device and the tool mount of the bending press by actuation of the first transfer device, actuation of the rotating installation and movement of the bending tools along the supply path.

Below, a possible general procedure of tool change will be described in more detail: the first transfer device (by means of a manipulator) removes a bending tool from a storage location and slides it into the rotating installation (also referred to as tool flipping unit). The manipulator can for example comprise a magnetic and/or mechanical gripper and/or a suction gripper.

The bending tool can then be flipped in the rotating installation or be pivoted into the supply line (supply path) in normal orientation. Subsequently, the second transfer device (also referred to as bending line manipulator) slides the tool to the desired position in the tool mount of the bending press. Due to the separation of the second transfer device and the first transfer device, these can operate independently. While the second transfer device is still moving the tool, the first transfer device can already remove a further tool from a storage location and load the rotating installation therewith.

The bending tool storage device can comprise the same components for upper tools and lower tools: storage locations, first transfer devices, rotating installation and second transfer devices.

Storage and loading of the upper and lower tools are carried out independently according to the principle described above.

In an embodiment as a shelf storage, the lower tools respectively stand in tool guides and the upper tools respectively hang in tool guides. Several tools of the same type can be stored in the tool guide of a storage location. In order to increase the storage capacity, the shelf can be stretched in length or built higher. The height and side distances are adapted in accordance with the tool to be stored.

The rotating installation represents the connector between the first and second transfer devices. The tool is slid into and/or pulled into the rotating installation and pivoted to the bending line by rotation either to the left or to the right. By means of the rotating installation, the orientation (turn of the tool) can be defined. The second transfer device can be designed such that it slides the tool into the tool mount of the bending press through the rotating installation and/or (in reverse direction) pulls the tool out of the bending press into the rotating installation.

For the purpose of better understanding of the invention, it will be elucidated in more detail by means of the figures below.

Figure 9:
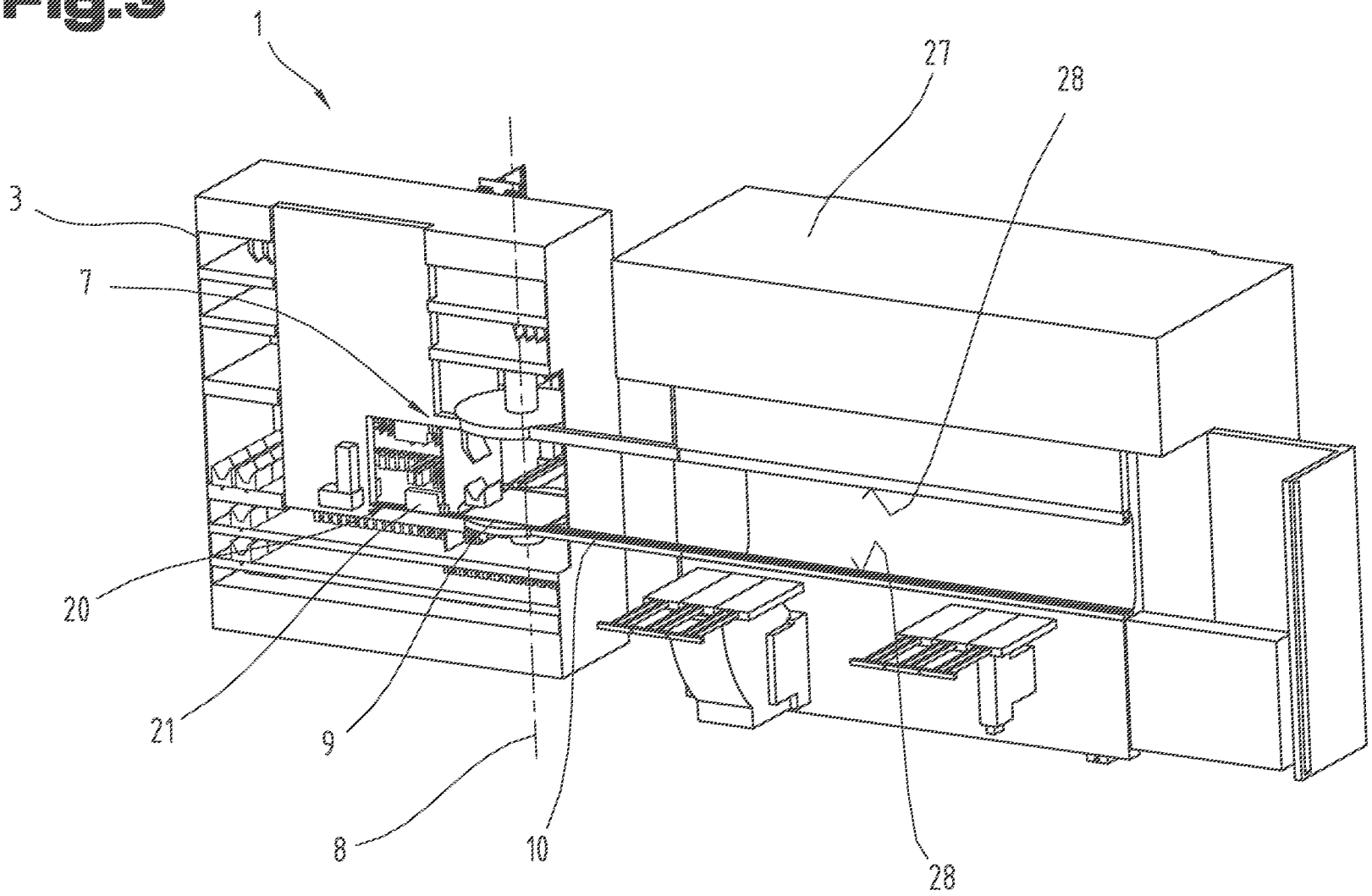
Figure 2:
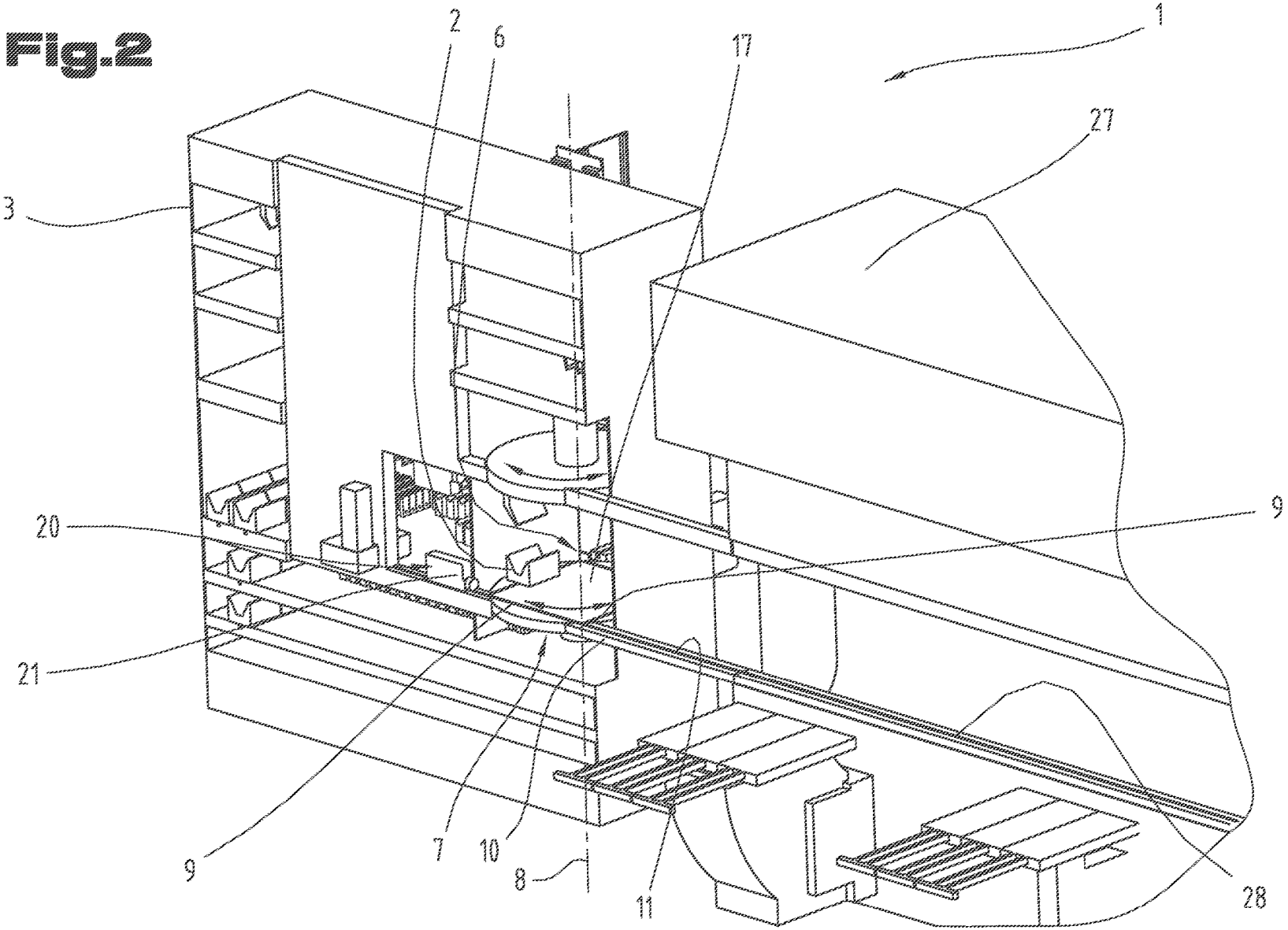
Figure 4:
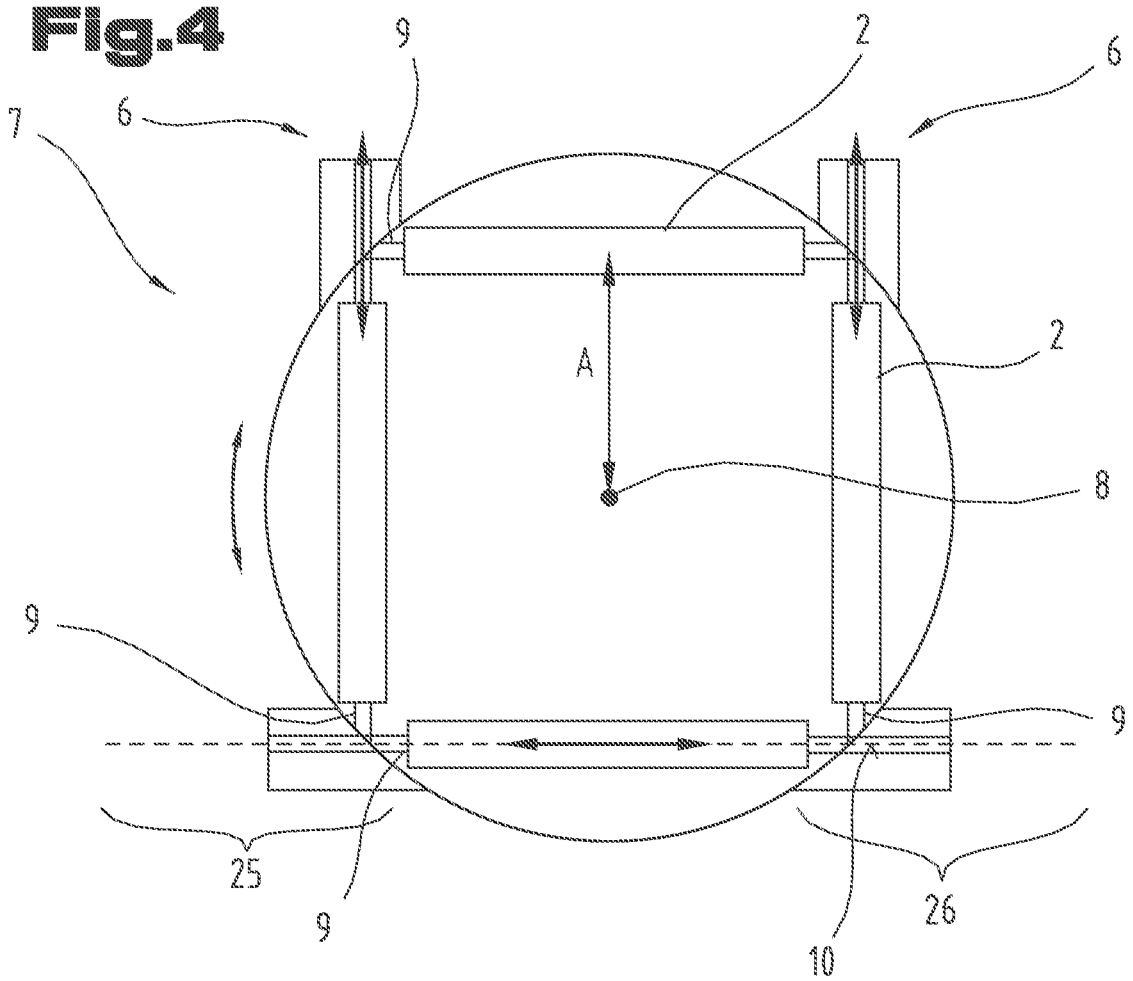
Figure 5:
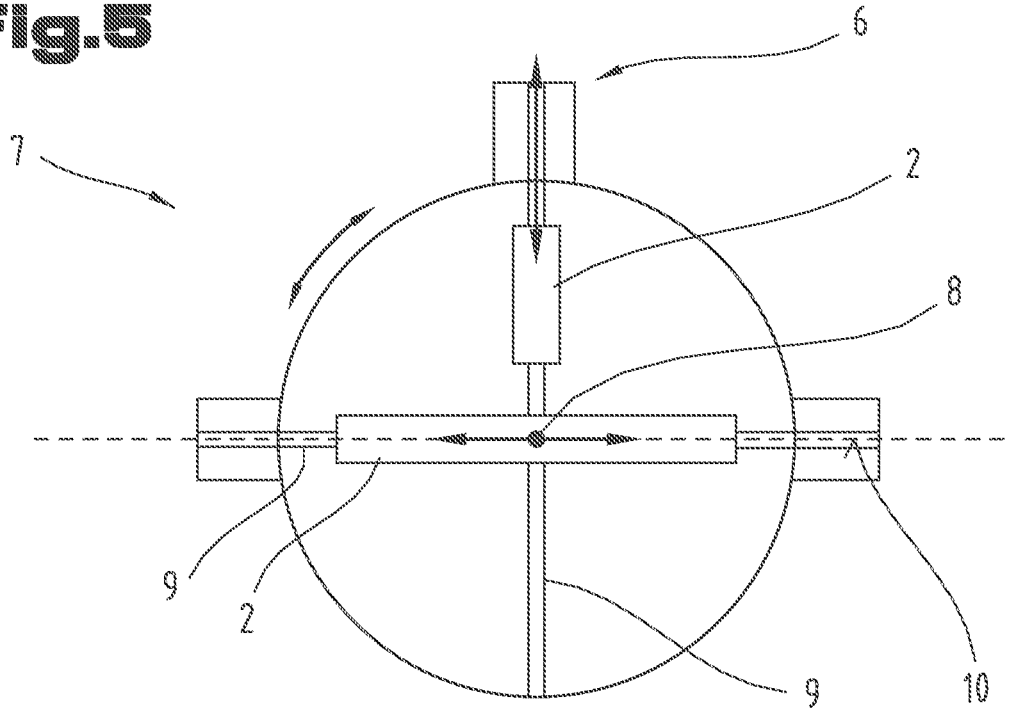
Figure 6:
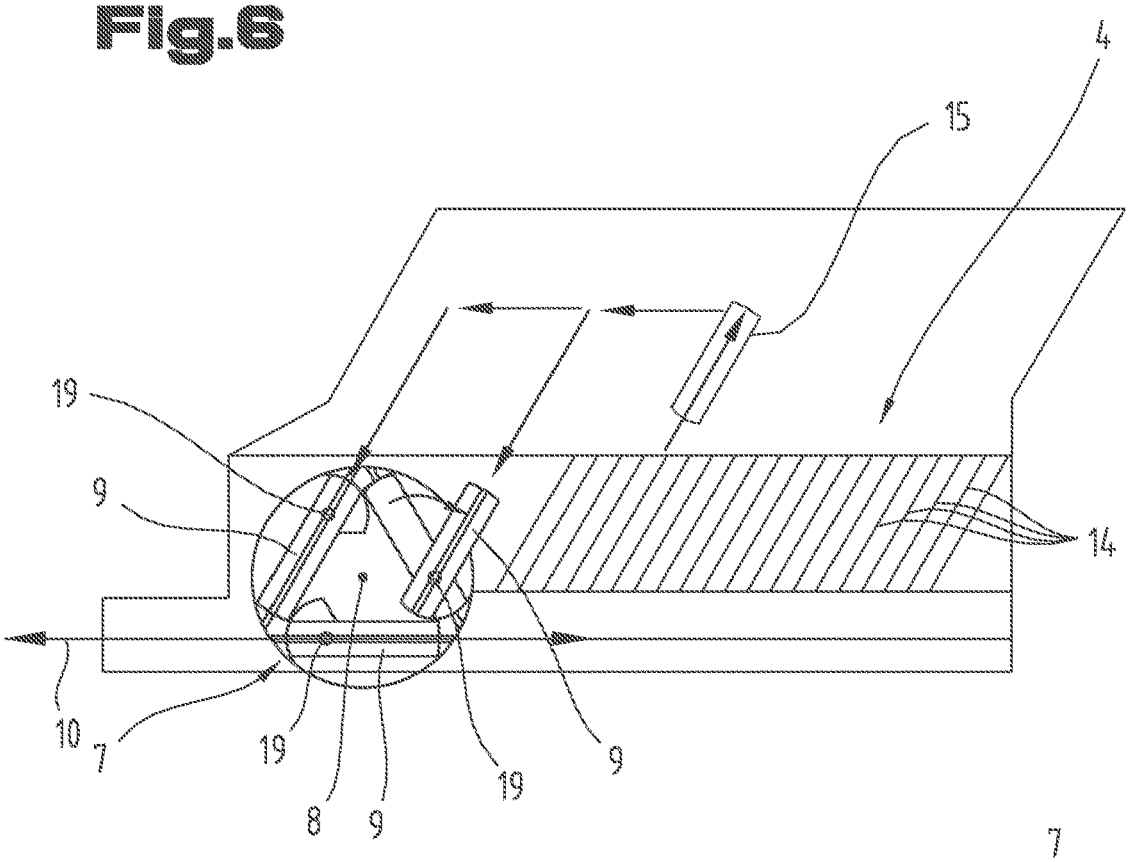
Figure 7:
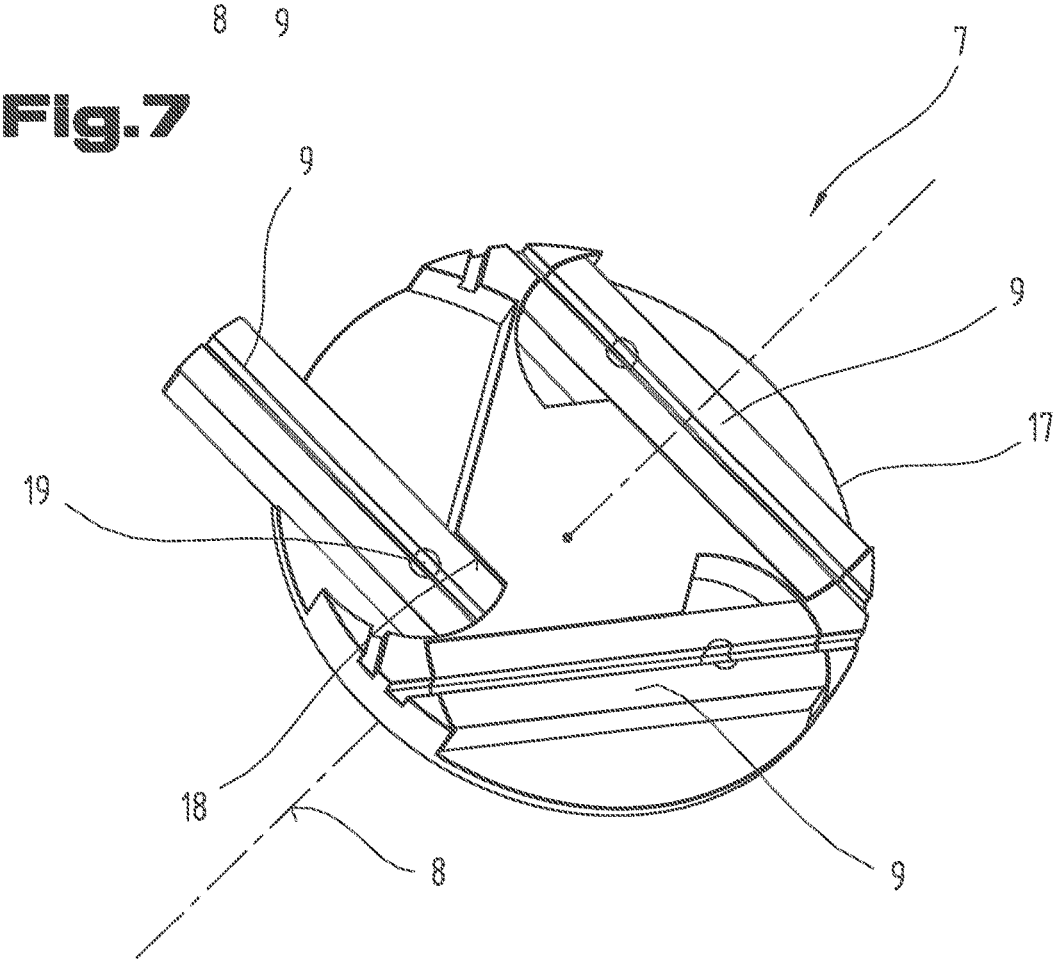
Figure 8:
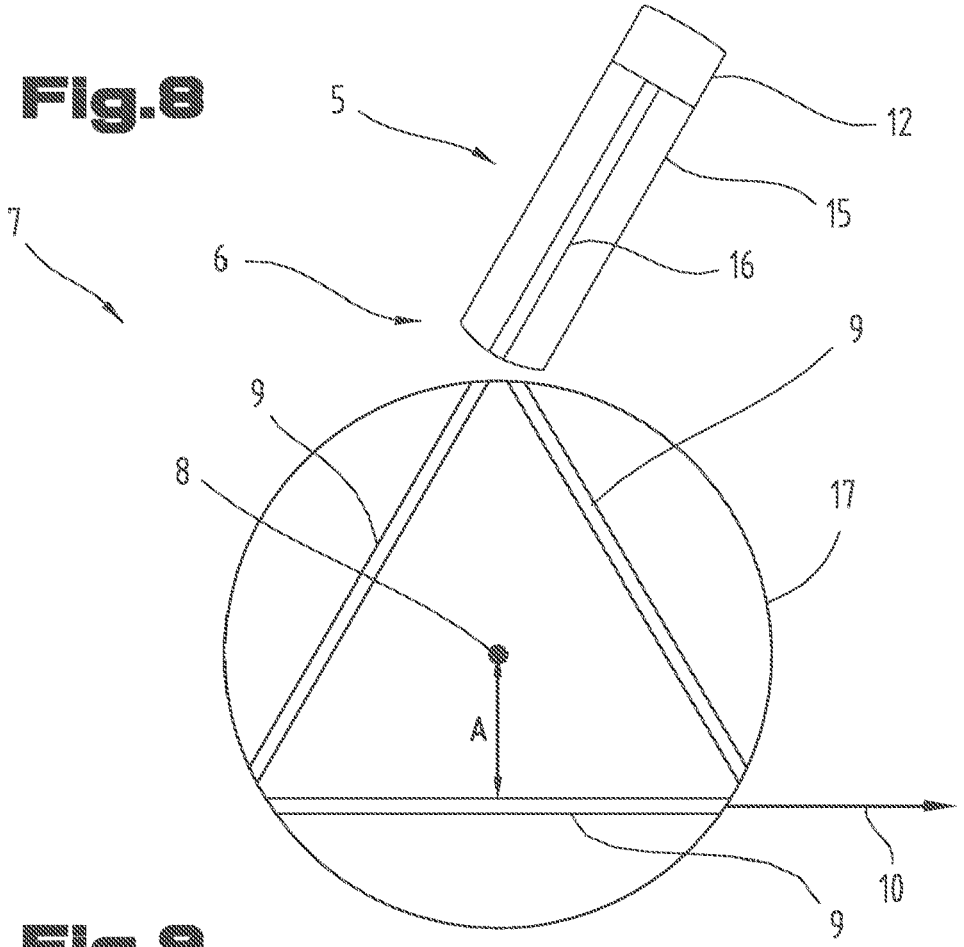
Figure 9:
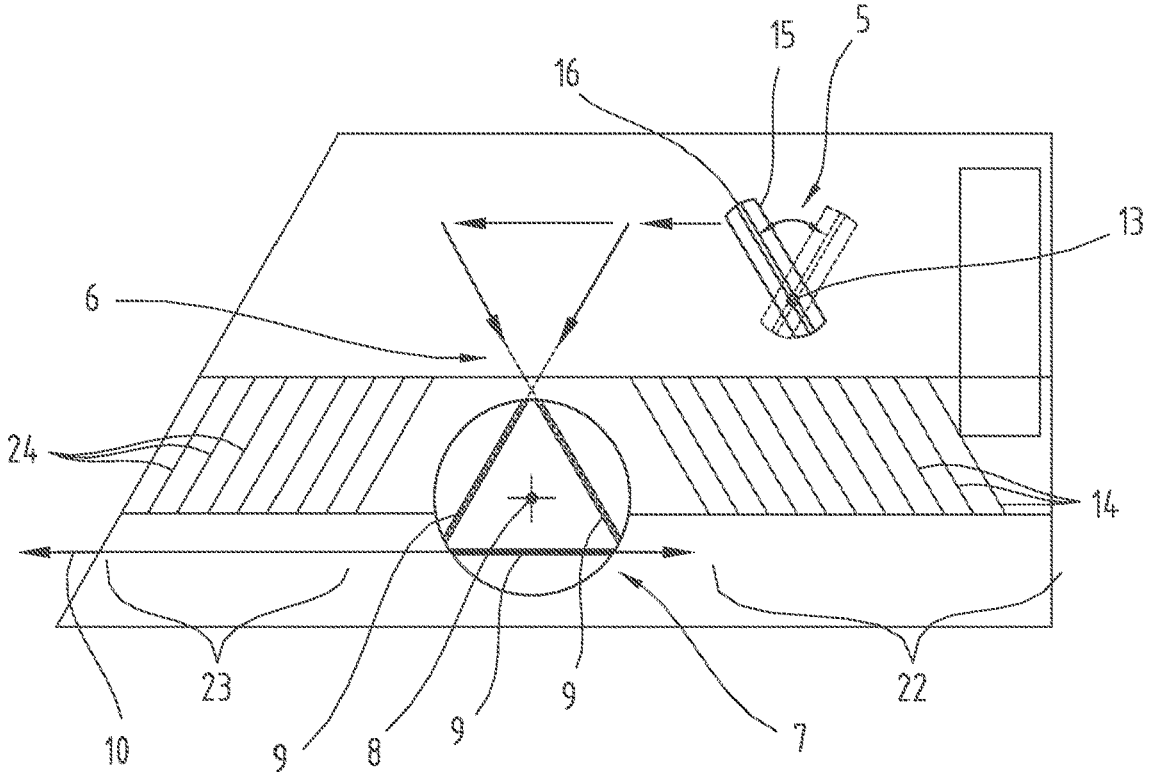
Figure 10:
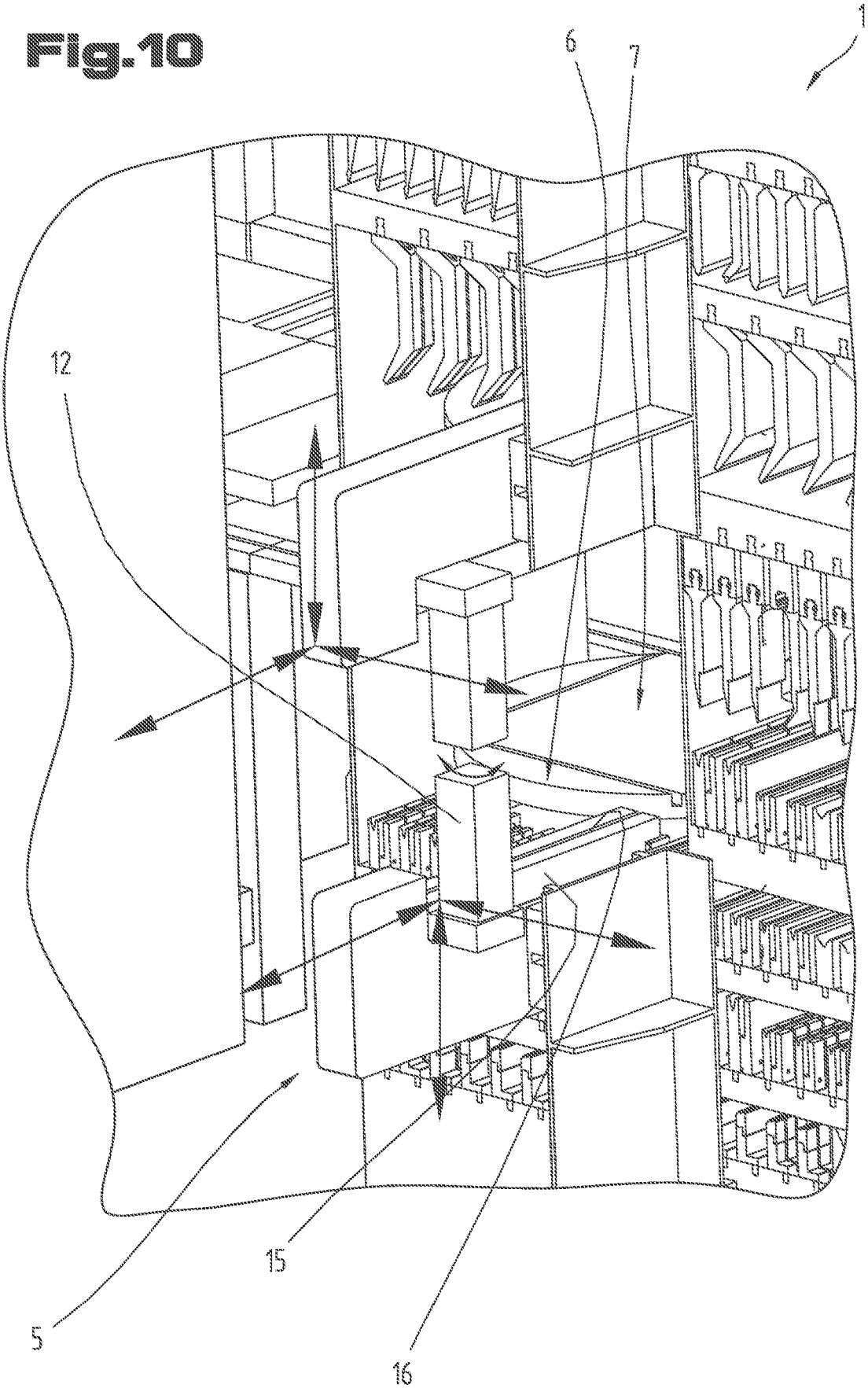
Figure 11:
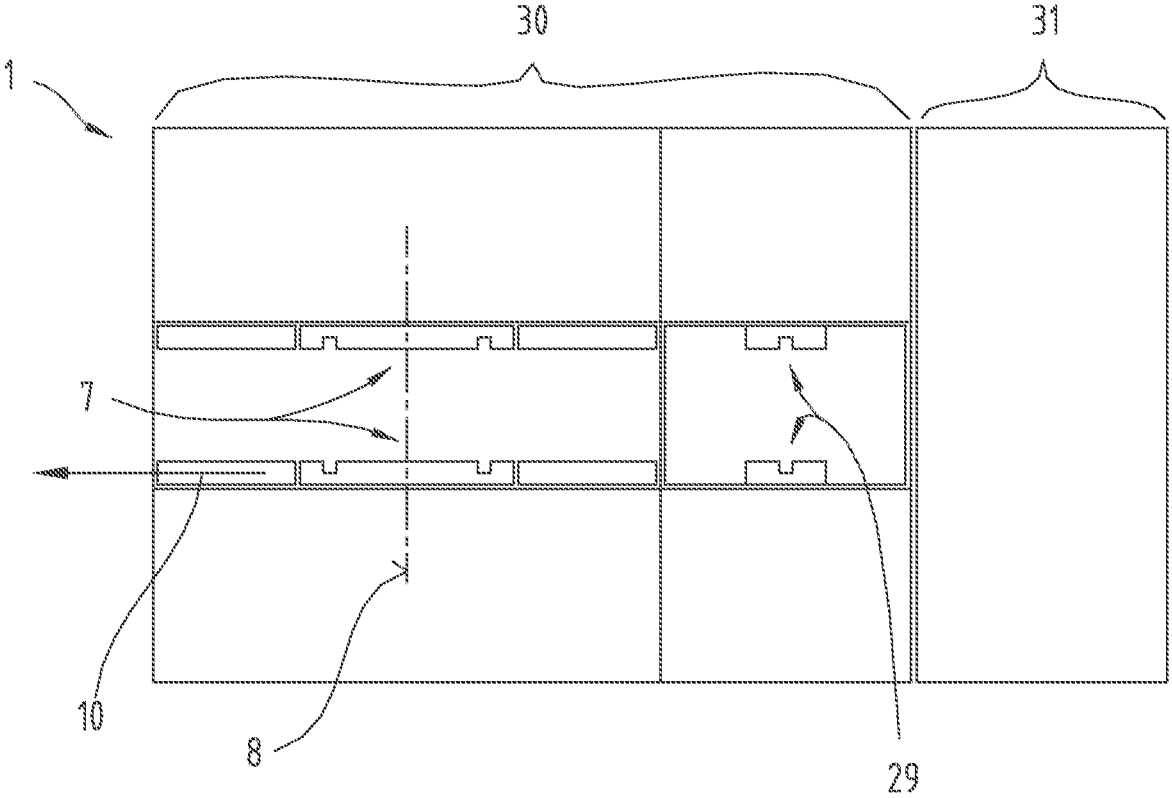
Figure 12:
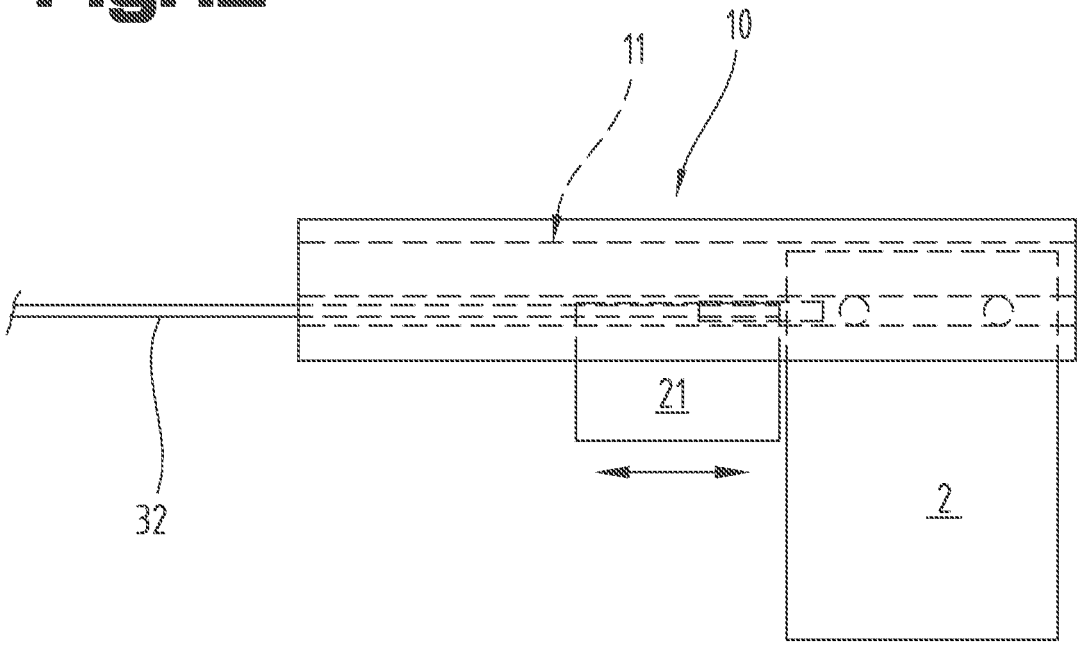

These show in a respectively very simplified schematic representation:

FIG. 1 a bending tool storage device as viewed from a first side;

FIG. 2 the bending tool storage device as viewed from the opposite side;

FIG. 3 a bending press connected to the storage device;

FIG. 4 a rotating installation with four tool guides;

FIG. 5 a rotating installation with two crossing tool guides;

FIG. 6 a variant of a storage device;

FIG. 7 a variant of a rotating installation with pivotable tool guides;

FIG. 8 a variant of a rotating installation with three tool guides;

FIG. 9 a further variant of a storage device;

FIG. 10 an enlarged detail from FIG. 1;

FIG. 11 a variant with loading station and modular construction;

FIG. 12 a shuttle coupled to a bending tool in the tool guide of the supply path.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

FIGS. 1, 2 and 3 show a bending tool storage device 1 for storing bending tools 2. A plurality of storage locations 4 with bending tools 2 (here: upper and lower tools) are arranged on a shelf-type rack 3.

Below, the components relating to lower tools of the storage device 1 will be described in more detail. The components relating to upper tools function according to same principle, except for the fact that the upper tools are transported and stored while hanging (not standing).

FIG. 2 shows a supply path 10 in the form of a tool guide 11 along which the bending tools 2 are output and taken in.

A first transfer device for transferring bending tools 2 between the storage locations 4 and a transfer point 6 is arranged on the opposite side (FIG. 1).

The storage device comprises a rotating installation 7 for rotating the bending tools 2 between the transfer point 6 and the supply path 10. The rotating installation represents a connector between the first transfer device 5 and a second transfer device 20 (described in more detail below).

The rotating installation 7 comprises at least one tool guide 9 that is rotatable about a preferably vertical rotation axis 8 and is in aligned orientation with the supply path 10 in a first rotational position and points towards the transfer point 6 in a second rotational position (see FIGS. 1 and 10). The rotational angle between the first rotational position and the second rotational position preferably amounts to at least 45°, preferably at least 60° (also see the variants according to FIGS. 4, 5 and 8 in which this rotational angle amounts to 90° and/or 120°).

It is preferred if the rotating installation 7 comprises at least two tool guides 9 rotatable about the rotation axis 8, wherein the tool guides 9 are tilted towards one another, preferably by an angle of at least 60°. An embodiment with two tool guides 9 is shown in FIG. 5, with three tool guides 9 in FIGS. 7 and 8 and with four tool guides 9 in FIG. 4.

The tool guides 9 of the rotating installation 7 are arranged on a disc-shaped platform 17 mounted so as to be rotatable about the rotation axis 8.

A first tool guide 9 of the rotating installation 7 is in aligned orientation with the supply path 10 and a second tool guide 9 of the rotating installation 7 points towards the transfer point 6 in at least one rotational position of the rotating installation.

FIG. 7 shows a particular embodiment in which the tool guides 9 of the rotating installation 7 are pivotable relative to the platform 17 about pivot axes 19, which are spaced from the rotation axis 8 and parallel to the rotation axis 8. Hence—as is shown in FIG. 6—the bending tool can be passed to the rotating installation or unloaded from the rotating installation at two positions, whereby the possibilities for loading and storing operations are extended. In particular, the transfer device 5 can pass a bending tool to a tool guide 9 of the rotating installation 7, then move to the second position and remove another bending tool from the rotating installation 7 from another tool guide 9 of the rotating installation 7 there and bring it to a storage location 4.

The pivoting movement of the tool guides 9 about the pivot axis 19 can be limited by a stop 18 preferably provided on the platform 17. A drive (not depicted) can be controlled by means of a controller to effect this pivoting movement about the pivot axis 19.

The tool guides of the rotating installation 7 are designed such that each tool guide between its first end and its second end passes a plane, which is perpendicular to the longitudinal direction of the respective tool guide and contains the rotation axis 8. The first end and the second end of the respective tool guides 9 of the rotating installation 7 essentially have the same distances from the rotation axis 8 in all represented embodiments.

While the tool guides 9 cross in FIG. 5, the tool guides 9 in FIGS. 4 and 8 are arranged without crossing. They comprise a distance A to the rotation axis 8 at the point where they come closest to the rotation axis 8, wherein the distance A preferably amounts to at least a quarter of the length of the tool guide 9.

It is particularly preferred for the tool guides 9 of the rotating installation 7 to extend along the sides of a preferably equilateral polygon, preferably an equilateral triangle or a square.

Below, the storage locations 4 and the first transfer device 5 will be described in more detail:

The storage locations 4 each comprise a tool guide 14 for retaining and guiding at least one bending tool 2 (FIGS. 1, 6 and 9).

The tool guides 14 of the storage locations 4 are tilted towards the tool guide 11 of the supply path 10, preferably by an angle of at least 45°, particularly preferred by an angle of at least 60°. In FIG. 1, this angle amounts to 90°, in FIG. 6 this angle amounts to 60°.

The first transfer device 5 for holding a bending tool 2 comprises a tool holder 15 by means of which the storage locations 4 and the transfer point 6 can be approached. The tool holder 15 comprises a tool guide 16 for retaining and guiding at least one bending tool 2. The tool guide 16 of the tool holder 15 can be brought into aligned orientation with the tool guides 14 of the storage locations 4, such that a bending tool 2 can be moved from a storage location 4 approached into the tool holder 15.

In the particular embodiment of FIG. 9, the tool guide 16 of the tool holder 15 is pivotable about a pivot axis 13 that is parallel to the rotation axis 8 of the rotating installation 7 (here by an angle of at least 60°). Hence, two tool guides 9 of the rotating installation 7 can be loaded (see the two arrows tilted by 60° in FIG. 9) without the rotating installation 7 having to be rotated.

The first transfer device 5 can comprise a manipulator 12 displaceable with the tool holder 15 (schematically represented in FIGS. 1 and 8) by means of which a bending tool 2 can be moved along the tool guide 14, 16 into the and/or out of the tool holder 15.

The storage device 1 also comprises a second transfer device 20 by means of which a bending tool 2 can be moved along the tool guide 11 of the supply path 10 (FIGS. 2 and 3).

The second transfer device 20 can comprise a shuttle 21, preferably in the form of a carriage or trolley, displaceable along the tool guide 11, preferably in the tool guide 11 of the supply path 10. The shuttle 21 can comprise a detachable (for example mechanical or magnetic or suction) coupling for connecting a bending tool 2 to the shuttle 21. The shuttle 21 can be selfdriving or be displaced by means of an elongated traction/pressure transfer means (in particular a chain) (not depicted). The traction/pressure transfer means can also be displaceable in the tool guide 11 of the supply path 10.

If—as is shown in FIG. 9—storage locations 4 of a first group 22 of storage locations are formed by first tool guides 14 parallel to one another and storage locations of a second group 23 of tool guides are formed by second tool guides 24 parallel to one another, wherein the first tool guides 14 are tilted towards the second tool guides 24 (here by an angle of 60°), best use can be made of the available space. This in particular holds true if the rotating installation 7 is arranged between storage locations 4 of the first group 22 and storage locations 4 of the second group 23.

It can further be seen from FIG. 1 that the rotating installation 7 is supported by the rack 3 and is arranged in a shelf compartment of the rack 3.

The supply path 10 can comprise a first guiding section 25 and a second guiding section 26, wherein at least a part of the second transfer device 20 (here the shuttle 21) is arranged in the first guiding section 25 in its retracted position and wherein a bending tool 2 can be moved out of the and/or into the storage device 1 along the second guiding section 26. At least one section of the rotating installation 7 is arranged between the first guiding section 25 and the second guiding section 26 of the supply path 10 (see for example FIG. 4).

As can be seen from FIG. 1, the storage locations 4 are arranged in at least two planes, wherein several storage locations 4 can be arranged in a shelf compartment of the rack 3. In the represented embodiment, at least a part of the storage locations 4 is arranged below and/or above the rotating installation 7.

A preferred aspect also is that the at least one first transfer device 5 is arranged on a first side of the rack 3 (FIG. 1) and the supply path 10 is arranged on a side of the rack 3 opposing the first side (FIG. 2). The rotating installation 7 forms a passage between the opposing sides of the rack 3.

FIG. 3 shows an arrangement of a bending press 27 and a bending tool storage device 1 connected to the bending press. In a method for loading a bending press 27 with bending tools 2 and/or for changing bending tools 2 in the bending press 27, bending tools 2 are output to the bending press 27 and/or taken in by the bending press 27 between the storage locations 4 of the bending tool storage device 1 and the tool mount 28 of the bending press 27 by actuation of the first transfer device 5, actuation of the rotating installation 7 and movement of the bending tools 2 along the supply path 10 (by means of the second transfer device 20).

It is to be considered a great advantage that the first and second transfer devices can operate independently, whereby the cycle times in the production of workpieces can be significantly reduced.

While FIG. 3 merely shows a storage device 1 connected to the bending press 27, two storage devices could be connected to the bending press in a further embodiment. In this regard, it is preferred if a first storage device is connected on one side of the bending press (see FIG. 3) and a second storage device is connected at the opposite side of the bending press. By providing two storage devices, the equipping and changing operations can be further abbreviated.

FIG. 11 shows a storage device 1 which can be extended in a modular manner and/or is formed by at least two storage modules 30, 31, that are connected to one another in a detachable manner and each comprise a plurality of storage locations 4. In this regard, the rotating installation 7 can be placed in the first storage module 30 while the second storage module 31 can accommodate storage locations 4 only. The first transfer device 5 (not shown in FIG. 11) can be designed such that it can approach the storage locations of the first and second storage modules.

FIG. 11 also shows a loading station 29 accessible from outside the storage device 1, for example via a loading hatch, for in particular manually loading the storage device 1 with bending tools 2 (here for upper and lower tools). The loading station 29 can be approachable by means of the first transfer device 5 and is preferably formed by at least one tool guide. Hence, the bending tools that are placed in the loading station can be collected by the first transfer device in the same way as the bending tools that are arranged in the storage locations. The tool guide of the loading station 29 is preferably parallel to the tool guides of the storage locations 4.

FIG. 12 lastly shows the second transfer device 20. A shuttle 21 is displaceable along the tool guide 11, here even in the tool guide 11 of the supply path 10 and/or (in the further course) in the tool mount 28 of a connected bending press 27 (see FIG. 3). The shuttle 21 is pushed and/or pulled by means of an elongated traction/pressure transfer means 32. The transfer means 32 is preferably formed of chain links. The traction and pressure transfer means 32 is displaceable along the tool guide 11, here in the tool guide 11 of the supply path 10 and/or (in the further course) in the tool mount 28 of a connected bending press 27 (see FIG. 3).

Ultimately, it should be noted that the components, in particular the first transfer device, the second transfer device and the rotating installation can be controlled by means of a controller. The interaction between these components can thus be optimized.

| List of reference numbers | |
|---|---|
| 1 | bending tool storage device |
| 2 | bending tool |
| 3 | rack |
| 4 | storage location |
| 5 | first transfer device |
| 6 | transfer point |
| 7 | rotating installation |
| 8 | rotation axis |
| 9 | tool guide |
| 10 | supply path |
| 11 | tool guide |
| 12 | manipulator |
| 13 | pivot axis |
| 14 | tool guide |
| 15 | tool holder |
| 16 | tool guide |
| 17 | platform |
| 18 | stop |
| 19 | pivot axis |
| 20 | second transfer device |

-continued

| List of reference numbers | |
|---|---|
| 21 | shuttle |
| 22 | first group of storage locations |
| 23 | second group of storage locations |
| 24 | tool guides |
| 25 | first guiding section |
| 26 | second guiding section |
| 27 | bending press |
| 28 | tool mount |
| 29 | loading station |
| 30 | first storage module |
| 31 | second storage module |
| 32 | traction/pressure transfer means |

The invention claimed is:

1. A bending tool storage device (1) for storing bending tools (2), the bending tool storage device (1) comprising:

a rack (3) on which a plurality of storage locations (4) for the bending tools (2) are arranged, each of the plurality of storage locations (4) for storing therein at least a respective one of the bending tools (2), at least one supply path (10) in the form of a supply path tool guide (11), the at least one supply path (10) for supplying the bending tools (2) to a bending press (27) and/or for retrieving the bending tools (2) from the bending press (27), at least one first transfer device (5) for transferring the bending tools (2) between the plurality of storage locations (4) and a transfer point (6), wherein the bending tool storage device (1) comprises, between the transfer point (6) and the at least one supply path (10), a rotating installation (7) for orienting the bending tools (2), wherein the rotating installation (7) comprises at least one tool guide (9) rotatable about a rotation axis (8), said at least one tool guide (9) being in aligned orientation with the at least one supply path (10) in a first rotational position and pointing towards the transfer point (6) in a second rotational position, wherein the plurality of storage locations (4) are arranged in at least two vertically spaced planes, wherein each storage location (4) of the plurality of storage locations (4) has a respective longitudinal axis, wherein for a first group (22) of storage locations of the plurality of storage locations, the longitudinal axes of two horizontally adjacent storage locations (4) of the first group (22) of storage locations extend parallel to one another, wherein the at least one first transfer device (5) further comprises a tool holder (15) for holding a given bending tool (2) of the bending tools (2), the tool holder (15) being displaceable both horizontally and vertically, wherein the plurality of storage locations (4) and the transfer point (6) can be approached by the at least one first transfer device (5), wherein the storage device (1) further comprises at least one second transfer device (20) that is configured to move the given bending tool (2) of the bending tools (2) along the supply path tool guide (11), and wherein the rotating installation (7) is supported by the rack (3) such that the rotating installation (7) is arranged in a shelf compartment of the rack (3).

2. The storage device according to claim 1, wherein a rotational angle between the first rotational position and the second rotational position amounts to at least 45°.

3. The storage device according to claim 1, wherein the rotating installation (7) comprises at least two tool guides (9) rotatable about the rotation axis (8), and wherein the at least two tool guides (9) are tilted towards one another.

4. The storage device according to claim 3, wherein the at least two tool guides (9) of the rotating installation (7) are arranged on a platform (17) mounted so as to be rotatable about the rotation axis (8).

5. The storage device according to claim 4, wherein one of the at least two tool guides (9) of the rotating installation (7) is pivotable relative to the platform (17) about a pivot axis (19), and wherein the pivot axis (19) is spaced apart from the rotation axis (8) and extends parallel to the rotation axis (8).

6. The storage device according to claim 5, wherein the pivoting movement about the pivot axis (19) by the one of the at least two tool guides (9) is limited by a stop (18) provided on the platform (17).

7. The storage device according to claim 4, wherein between a first end of the at least one tool guide (9) and a second end of the at least one tool guide (9) passes a plane (E), which is perpendicular to the longitudinal axis of the at least one tool guide (9) and contains the rotation axis (8) about which the platform (17) rotates, and/or wherein the first end and the second end of the at least one tool guide (9) of the rotating installation (7) are disposed at a same distance from the rotation axis (8).

8. The storage device according to claim 4, wherein the platform (17) is disc-shaped.

9. The storage device according to claim 3, wherein one of the at least two tool guides (9) of the rotating installation (7) is in aligned orientation with the at least one supply path (10), and a second one of the at least two tool guides (9) of the rotating installation (7) points towards the transfer point (6) in at least one rotational position of the rotating installation (7).

10. The storage device according to claim 3, wherein the at least two tool guides (9) of the rotating installation (7) extend along the sides of an equilateral polygon.

11. The storage device according to claim 1, wherein the at least one tool guide (9) of the rotating installation (7) is disposed such that at a position at which the at least one tool guide (9) is closest to the rotation axis (8), a distance (A) between the rotation axis (8) and the at least one tool guide (9) amounts to at least a quarter of the length of the at least one tool guide (9).

12. The storage device according to claim 1, wherein the plurality of storage locations (4) each comprise a respective tool guide (14) for retaining and guiding at least one bending tool (2) of the bending tools (2).

13. The storage device according to claim 12, wherein the respective tool guides (14) of the plurality of storage locations (4) are tilted towards the supply path tool guide (11).

14. The storage device according to claim 1, wherein the tool holder (15) comprises a tool guide (16) provided for each of retaining and guiding the given bending tool (2) of the bending tools (2), and wherein the tool guide (16) of the tool holder (15) can be brought into aligned orientation with respective tool guides (14) of the plurality of storage locations (4).

15. The storage device according to claim 14, wherein the tool guide (16) of the tool holder (15) is pivotable about a pivot axis (13), which extends parallel to the rotation axis (8) of the rotating installation (7).

16. The storage device according to claim 1, wherein the at least one first transfer device (5) comprises a manipulator (12), which can be displaced with the tool holder (15), and wherein the manipulator is configured to move a given bending tool (2) of the bending tools (2) along the tool guide (16) into the tool holder (15) and/or out of the tool holder (15).

17. The storage device according to claim 1, wherein the at least one second transfer device (20) can be controlled independently of and/or temporally parallel to the at least one first transfer device (5).

18. The storage device according to claim 17, wherein the at least one second transfer device (20) comprises a shuttle (21) that is displaceable along the supply path tool guide (11).

19. The storage device according to claim 18, wherein the shuttle (21) comprises a releasable coupling for connecting the given bending tool (2) of the bending tools (2) to the shuttle (21).

20. The storage device according to claim 17, wherein the at least one second transfer device (20) comprises an extendable elongated traction and pressure transfer means (32), which can be moved along the supply path tool guide (11).

21. The storage device according to claim 1, wherein respective storage locations (4) of the first group (22) of the plurality of storage locations are formed by first tool guides (14) that extend parallel to one another, and wherein respective storage locations of a second group (23) of the plurality of storage locations are formed by second tool guides (24) that extend parallel to one another, and wherein the first tool guides (14) are tilted towards the second tool guides (24).

22. The storage device according to claim 21, wherein the rotating installation (7) is arranged between the storage locations (4) of the first group (22) and the storage locations (4) of the second group (23).

23. The storage device according to claim 1, wherein the at least one supply path (10) comprises a first guiding section (25) and a second guiding section (26), wherein at least a part of the at least one second transfer device (20) is arranged in the first guiding section (25) in a retracted position, wherein a given bending tool (2) of the bending tools (2) can be moved out of and/or into the storage device (1) along the second guiding section (26), and wherein at least a part of the rotating installation (7) is arranged between the first guiding section (25) and the second guiding section (26) of the at least one supply path (10).

24. The storage device according to claim 1, wherein at least some of the plurality of storage locations (4) are arranged below and/or above the rotating installation (7).

25. The storage device according to claim 1, wherein the at least one first transfer device (5) is arranged on a first side of the rack (3) and the at least one supply path (10) is arranged on a side of the rack (8) opposing the first side, and wherein the rotating installation (7) forms a passage between the opposing sides of the rack (3).

26. The storage device according to claim 1, wherein the at least one first transfer device (5), the at least one second transfer device (20) and the rotating installation (7) each comprise at least one drive and/or actuator and can be controlled by a controller.

27. The storage device according to claim 1, wherein the storage device (1) can be extended in a modular manner and/or is formed by at least two storage modules (80, 31) that are connected to one another in a detachable manner and each comprise a respective plurality of storage locations (4).

28. The storage device according to claim 1, wherein the storage device (1) comprises at least one loading station (29) accessible from outside the storage device (1), and wherein the at least one loading station (29) can be approached by the at least one first transfer device (5) and/or is formed by at least one tool guide.

29. The storage device according to claim 1, wherein the rack (3) comprises a shelf-type rack.

30. The storage device according to claim 1, wherein a rotational angle between the first rotational position and the second rotational position amounts to at least 60°.

31. The storage device according to claim 1, wherein the rotation axis (8) is a vertical rotation axis.

32. A method for loading a bending press (27) with bending tools (2) and/or for changing the bending tools (2) in the bending press (27), the method comprising:

providing the bending tool storage device (1) of claim 1 such that the bending press (27) is connected to the bending tool storage device (1) of claim 1, and wherein the bending tools (2) are moved between the plurality of storage locations (4) of the bending tool storage device (1) and a tool mount (28) of the bending press (27) through actuation of the at least one first transfer device (5), actuation of the rotating installation (7), and movement of the bending tools (2) along the at least one supply path (10).

33. A bending tool storage device (1) for storing bending tools (2), the bending tool storage device (1) comprising:

a rack (3) on which a plurality of storage locations (4) for the bending tools (2) are arranged, each of the plurality of storage location for storing therein at least a respective one of the bending tools (2), at least one supply path (10) in the form of a supply path tool guide (11), the at least one supply path (10) for supplying the bending tools (2) to a bending press (27) and/or for retrieving the bending tools (2) from the bending press (27), at least one first transfer device (5) for transferring the bending tools (2) between the plurality of storage locations (4) and a transfer point (6), wherein the bending tool storage device (1) comprises, between the transfer point (6) and the at least one supply path (10), a rotating installation (7) for orienting the bending tools (2), wherein the rotating installation (7) comprises at least three tool guides (9) rotatable about a rotation axis (8), each of said at least three tool guides (9) being in aligned orientation with the at least one supply path (10) in a first rotational position and pointing towards the transfer point (6) in a second rotational position, wherein each of the at least three tool guides (9) of the rotating installation (7) is disposed at a respective position such that a distance from the rotation axis (8) and the respective position of each of the at least three tool guides (9) is a first distance (A), wherein the at least three tool guides (9) of the rotating installation (7) extend along the sides of an equilateral polygon having an equilateral polygonal shape, and the at least three tool guides (9) of the rotating installation (7) are aligned such that the longitudinal axes of the at least three tool guides (9) coincide with the sides of the equilateral polygon so as to form the equilateral polygonal shape of the equilateral polygon.

34. A bending tool storage device (1) for storing bending tools (2), the bending tool storage device (1) comprising:

a shelf-type rack (3) on which a plurality of storage locations (4) are arranged, each of the plurality of storage locations for storing therein at least a respective one of the bending tools (2), at least one supply path (10) in the form of a supply path tool guide (11), the at least one supply path (10) for supplying the bending tools (2) to a bending press (27) and/or for retrieving the bending tools (2) from the bending press (27), at least one first transfer device (5) for transferring the bending tools (2) between the plurality of storage locations (4) and a transfer point (6), the at least one first transfer device (5) comprising a transfer device tool guide (16), wherein the bending tool storage device (1) comprises, between the transfer point (6) and the at least one supply path (10), a rotating installation (7) for orienting the bending tools (2), wherein the rotating installation (7) comprises a platform (17) on which at least one platform tool guide (9) is disposed, the platform being rotatable about a rotation axis (8) such that in a first rotational position of the platform (17), a longitudinal axis of the at least one platform tool guide (9) is coaxial to a longitudinal axis of the supply path tool guide (11), and in a second rotational position of the platform (117), the longitudinal axis of the at least one platform tool guide (9) is coaxial to a longitudinal axis of the transfer device tool guide (16), and with respect to a vertical direction, the platform (17) is disposed in the shelf-type rack (3) between vertically-separated shelves of the shelf-type rack (3), and $wherein each storage location (4) of the plurality of storage locations (4) has a respective longitudinal axis, and the longitudinal axes of two horizontally adjacent storage locations (4) are parallel.

* * * * *